US009644600B2

(12) United States Patent
Aldosari

(10) Patent No.: US 9,644,600 B2
(45) Date of Patent: May 9, 2017

(54) ENERGY GENERATION FROM BUOYANCY EFFECT

(71) Applicant: Fahd Nasser J Aldosari, Riyadh (SA)

(72) Inventor: Fahd Nasser J Aldosari, Riyadh (SA)

( * ) Notice: Subject to any disclaimer, the term of this patent is extended or adjusted under 35 U.S.C. 154(b) by 51 days.

(21) Appl. No.: 14/868,431

(22) Filed: Sep. 29, 2015

(65) Prior Publication Data

US 2017/0089318 A1 Mar. 30, 2017

(51) Int. Cl.
*F03B 13/10* (2006.01)
*F03B 15/00* (2006.01)

(52) U.S. Cl.
CPC ..... *F03B 13/10* (2013.01); *F03B 15/00* (2013.01)

(58) Field of Classification Search
CPC ..... F03B 13/10; F03B 15/00; Y02E 10/38
USPC ..... 290/4 D, 42, 53
See application file for complete search history.

(56) References Cited

U.S. PATENT DOCUMENTS 3,918,260 A * 11/1975 Mahneke ..... F03B 13/189 417/330
4,754,157 A * 6/1988 Windle ..... F03B 13/189 290/42
6,392,314 B1 * 5/2002 Dick ..... F03B 13/148 290/53
2004/0163389 A1 * 8/2004 Gerber ..... F03B 13/1845 60/595
2007/0164568 A1 * 7/2007 Greenspan ..... F03B 13/1865 290/53
2009/0127860 A1 * 5/2009 Brown ..... E02B 9/08 290/53
2010/0043425 A1 * 2/2010 Dragic ..... F03B 13/1855 60/504
2010/0102562 A1 * 4/2010 Greenspan ..... F03B 13/1865 290/53
2010/0102563 A1 4/2010 Akervoll
2010/0107627 A1 * 5/2010 Morgan ..... B63B 35/44 60/495

(Continued)

FOREIGN PATENT DOCUMENTS

WO WO 2011/134061 A1 11/2011

OTHER PUBLICATIONS

Stewart Needham, "Renewable energy technologies update", Parliament of Australia, http://www.aph.gov.au/About_Parliament/Parliamentary_Departments/Parliamentary_Library/pubs/BN/0910/RenewableEnergy, Nov. 30, 2009, 47 pages.

*Primary Examiner* — Viet Nguyen
(74) *Attorney, Agent, or Firm* — Oblon, McClelland, Maier & Neustadt, L.L.P.

(57) ABSTRACT

A power generation apparatus for underwater power generation including at least two balloons completely submerged under a water surface of a water body, wherein a first balloon is filled with a gas and a second balloon is initially empty, a first and a second flexible hose, a plurality of hose reels, a plurality of pulleys, a cord connecting the first balloon and the second balloon, a pump connected to the first flexible hose and the second flexible hose in an airtight manner, a first valve, a second valve, at least two pressure sensors and at least two flow rate sensors, a generator. The apparatus further includes a power controller that reads data from the at least two pressure sensors and the at least two flow rate sensors to control the opening of the first valve, the second valve, and a pumping direction of the pump.

11 Claims, 5 Drawing Sheets

(56) References Cited

U.S. PATENT DOCUMENTS

| | | | | |
|---|---|---|---|---|
| 2011/0018275 | A1* | 1/2011 | Sidenmark | F03B 13/1815 290/53 |
| 2011/0081259 | A1* | 4/2011 | Vowles | F03B 13/1865 417/331 |
| 2011/0097220 | A1* | 4/2011 | Tillotson | F03B 13/189 417/333 |
| 2012/0096847 | A1* | 4/2012 | Boyd | E02B 9/08 60/497 |
| 2013/0269333 | A1* | 10/2013 | Williams | F03B 13/182 60/506 |
| 2014/0117671 | A1* | 5/2014 | Gregory | F03B 13/16 290/53 |
| 2015/0035283 | A1* | 2/2015 | Lee | F03B 13/1885 290/53 |
| 2015/0159623 | A1* | 6/2015 | Frich | F03B 13/1845 290/53 |
| 2015/0266549 | A1* | 9/2015 | Qu | F03D 3/02 248/550 |

* cited by examiner

ENERGY GENERATION FROM BUOYANCY EFFECT

GRANT OF NON-EXCLUSIVE RIGHT

This application was prepared with financial support from the Saudi Arabian Cultural Mission, and in consideration therefore the present inventor(s) has granted The Kingdom of Saudi Arabia a non-exclusive right to practice the present invention.

BACKGROUND

Field of the Disclosure

This application relates generally to an energy generation system. More particularly the present disclosure relates to improvements relating to buoyance based energy generation where the apparatus is installed under the water surface.

Description of the Related Art

Energy is primarily generated from non-renewable and renewable energy sources such as oil, coal, natural gas, uranium, wind, solar, and water. These sources of energy fuel power generation plants such as fossil fuel power plant, hydro-electric power plants, nuclear power plants, wind farms, and solar towers. The energy generated from the power plant is then transmitted to the electric grid, which distributes the energy in the form of electricity for industrial and domestic use. The demand for energy is ever increasing and existing energy generation units are not sufficient to meet the energy demand. Further, some the largest power plants depend on non-renewable energy source such as oil, natural gas and coal that will eventually be exhausted. Energy generation from non-renewable alone is not enough to meet the energy demand of present and future. To supplement the energy demand sustainable power generation systems are required.

One of the renewable and sustainable energy sources is water which is used to operate hydropower plants such as hydro-electric power plants, which produce power at a large scale and tidal power plants, which produce power at relatively small scale. A tidal power plant converts the tidal energy or wave energy into mechanical energy which is further transformed into electricity. A typical tidal power generation system using waves to generate power includes a floating device connected to a power generator through a pulley arrangement. As waves are generated on the surface of the water the floating devices moves up and down with the wave. The up and down motion of the floating device is converted into a rotation of a shaft which can be used to generate electricity.

Alternatively, power may be generated using a floating device connected to a motor that pulls the floating device underwater. When the floating device is released it rises to the water surface due to the buoyancy effect. This rising motion is then used to generate power.

The energy generated from tidal power is highly inefficient and inconsistent. Due to the increasing energy demand and exhaustible energy sources there remains a continuing need to provide new, efficient and continuous energy generation systems.

SUMMARY

According to an embodiment of the present disclosure, there is provided a power generation apparatus for underwater power generation. The apparatus includes at least two balloons completely submerged under a water surface of a water body, wherein a first balloon is filled with a gas and a second balloon is empty. A plurality of flexible hoses are connected to the at least two balloons in an airtight manner, wherein a first flexible hose of the plurality of flexible hoses is connected to the first balloon in an airtight manner and a second flexible hose of the plurality of flexible hoses is connected to the second balloon in an airtight manner. Further, a plurality of hose reels are attached to supports that are fixed to the floor underwater and each hose reel winds one of the plurality of the flexible hoses. A plurality of pulleys are hinged to a support fixed to the floor underwater, and a cord freely passes over the plurality of pulleys and connects to the first balloon and the second balloon. The apparatus also includes a pump connected to a first pipe and a second pipe, and the first pipe is further connected to the first flexible hose and the second pipe connected to the second flexible hose in an airtight manner. A first valve is located in the first pipe, and a second valve located in the second pipe. Furthermore, at least two pressure sensors and at least two flow rate sensors are included, wherein a first pressure sensor and a first flow rate sensor are connected to the first pipe and a second pressure sensor and a second flow rate sensor are connected to the second pipe. The apparatus further includes a power controller that reads and stores data from the at least two pressure sensors and the at least two flow rate sensors, controls the opening of the first valve and the second valve, and a pumping direction of the pump based on data from the at least two pressure sensors and the at least two flow rate sensors. A generator operated by the cord is used to produce power.

Further, according to an embodiment of the present disclosure, there is provided a method for controlling power generated from the power generation apparatus submerged underwater including a first balloon filled with a gas and a second balloon initially empty; a first pipe connected with a first pressure sensor, a first valve, a first flow rate sensor; a second pipe connected with a second pressure sensor, a second valve, a second flow rate sensor; and a pump connected to the first pipe and the second pipe, the method includes reading the first and the second pressure sensor, and the first and the second flow rate sensor data, calculating a difference in pressure based on the first and the second pressure sensor data, starting the pump based on the calculated pressure difference, controlling the first valve and the second valve based on the first and the second flow rate sensor data; and stopping the pump.

Further, according to an embodiment of the present disclosure, there is provided a non-transitory computer-readable medium which stores a program which, when executed by a computer, causes the computer to perform the method for controlling power generated from the power generation apparatus submerged underwater, as discussed above.

The forgoing general description of the illustrative implementations and the following detailed description thereof are merely exemplary aspects of the teachings of this disclosure, and are not restrictive.

DETAILED DESCRIPTION

Figure 1:
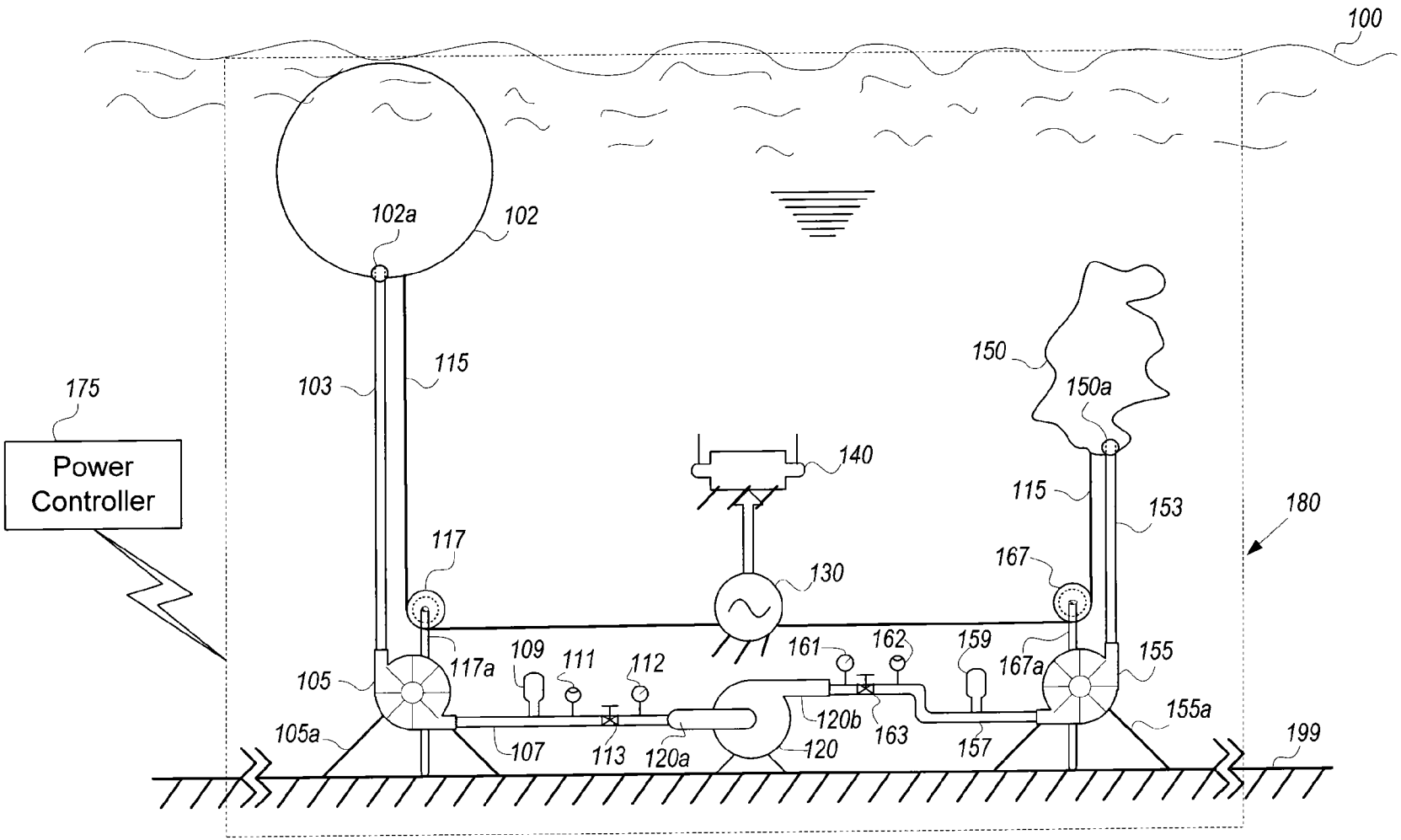
FIG. 1 illustrates an initial configuration of a buoyancy power generation system according to an exemplary embodiment of the present disclosure.

In the drawings, like reference numerals designate identical or corresponding parts throughout the several views. Further, as used herein, the words "a", "an" and the like generally carry a meaning of "one or more", unless stated otherwise. The drawings are generally drawn to scale unless specified otherwise or illustrating schematic structures or flowcharts.

Furthermore, the terms "approximately," "proximate," "minor," and similar terms generally refer to ranges that include the identified value within a margin of 20%, 10% or preferably 5% in certain embodiments, and any values therebetween.

FIG. 1 illustrates an initial configuration of a buoyancy power generation system. The buoyancy power generation system consists of a power generation apparatus 180 and a power controller 175. The power generation apparatus 180 includes at least two balloons—a first balloon 102 and an second balloon 150, a pump 120, a generator 130 and an energy storage device 140, flexible hoses 103 and 153, hose reels 105 and 155, reel supports 105*a* and 155*a*, a cord 115, pulleys 117 and 167, pulley supports 117*a* and 167*a*, a first pipe 107 and a second pipe 157, a first valve 113 and a second valve 163, a first pressure sensor 111 and a second pressure sensor 161, a first flow rate sensor 112, a second flow rate sensor 162, and a first accumulator 109 and a second accumulator 159.

In FIG. 1, the first balloon 102 is filled with gas such as air or helium and is placed below the water surface 100 during the entire lifetime of its operation. The first balloon 102 is connected to the flexible hose 103 via an air tight connection such as a ball and socket joint 102*a*, which also offers rotational flexibility to the first balloon 102. The flexible hose 103 maintains a stress free connection to the first balloon 102 particularly when there is an underwater current and the first balloon 102 drifts along the underwater current. The flexible hose 103 is extended from a hose reel 105. The hose reel 105 is firmly fixed to an underwater surface 199 via a reel support 105*a*. The hose reel 105 may include a rotating cylinder (not shown) around which the flexible hose 103 can be wound. The flexible hose 103 is further passed through the hose reel 105 and connected to the first pipe 107.

The first pipe 107 is connected to a first port of the pump 120. In one embodiment, the pump 120 can be a reversible or a bidirectional type of pump which can pump gas in both the direction. For example, a rotary screw type of pump, in which two screw-like gears are engaged with each other, or a reciprocating type of pump maybe used. In another embodiment the pump 120 can be a one way pump that pumps gas in only one direction, in which case a plurality of pumps may be required to operate the power generation apparatus 180. Further in one embodiment, the pump 120 can receive power from the energy storage device 140. In different embodiment, the pump 120 can receive power from an external power source place above the water surface.

The first pipe 107 is fitted with the first accumulator 109, the first pressure sensor 111, and the first valve 113. The first accumulator 109 stores excess gas and facilitates smooth transfer of gas from first balloon 102 to the pump 120 by absorbing any fluctuation of gas pressure from the first balloon 102 to the first pipe 107.

The second balloon 150 is significantly empty and is placed below the water surface 100 during the entire lifetime of its operation. The second balloon 150 occupies a height relatively lower than the first balloon 102. The second balloon 150 is connected to the flexible hose 153 via an air tight connection such as a ball and socket joint 150*a*, which also offers rotational flexibility to the second balloon 150. The flexible hose 153 maintains a stress free connection to the second balloon 150 particularly when there is an underwater current and the second balloon 150 drifts along the underwater current. The flexible hose 153 is extended from a hose reel 155. The hose reel 155 is firmly fixed to the underwater surface 199 via a reel support 155*a*. A typical hose reel 155 may include a rotating cylinder (not shown) around which the flexible hose 153 can be wound. The flexible hose 153 is further passed through the hose reel 155 and connected to the second pipe 157.

The second pipe 157 is connected to an second port 120*b* of the pump 120. Furthermore, the second pipe 157 is fitted with the second accumulator 159, the second pressure sensor 161, and the second valve 163. The second accumulator 159 stores excess gas and facilitates smooth transfer of gas from the pump 120 to the second balloon 150 by absorbing any fluctuation of gas pressure that may be created in the second pipe 157.

Thus the first balloon 102 and the second balloon 150 are interconnected via flexible hoses 103 and 153, first and second pipes 107 and 157, and the pump 120. This interconnection enables transfer of gas from the first balloon 102 to the second balloon 150.

Furthermore, the first balloon 102 is connected to the second balloon 150 via the cord 115. The cord 115 is connected to the balloons 102 and 150 slightly apart from the flexible hoses 103 and 153 respectively. The cord 115 connected from the first balloon 102 passes over the pulley 117, through the generator 130, and over the pulley 167 to the second balloon 150. The cord 115 remains in a significantly taut state during the operation of the power generation apparatus 180. The pulleys 117 and 167 rotate about the pulley supports 117*a* and 167*a* which are fixed to the underwater surface 199. Such a configuration of the cord 115, according to the embodiment of the present disclosure, enables power generation when the cord 115 is set in motion. For instance, the cord 130 can be wrapped around a generator shaft having grooves for cord 130 support. As the cord 130 is pulled by a rising balloon, the shaft starts to rotate, which is converted to electric power by the generator. Alternately, the cord 130 can be a chain, which engages with teeth of a sprocket installed on the generator shaft. As the chain is pulled by the rising balloon, the generator shaft rotates. The shaft rotation is eventually converted into electric power.

The power generated by the generator 130 can be stored in the energy storage device 140 such as a battery or send to an energy grid where the energy is directly transmitted to the household use via an electric transformer.

According to the embodiment of the present disclosure, the power controller 175 interacts with the energy generation apparatus 180. The power controller 175 reads data from the sensors such as the first pressure sensor 111 and the second pressure sensor 161 and controls the gas flow rate through the first pipe 107 and the second pipe 157 respectively by controlling the amount of opening of the first valve 113 and the second valve 163 respectively. The amount of opening of the valves 113 and 163 can be based on the pressure sensor data. The power controller 175 also determines when the pump 120 should start pump in a particular direction based on the pressure sensor data.

In another embodiment, the power controller 175 operation may be based on the length of the cord 115 or in combination with the pressure sensor data. For instance for a shorter cord length the amount of opening of the second valve 163 may be higher to allow higher gas flow rate to the second balloon 150. Furthermore, the length of the cord 115 can also be used to determine the pumping duration of the pump 120. For instance the time required to fill the second balloon 150 at different depths of water at a predetermined gas flow rates may be calculated experimentally as a part of the installation and setup process of the power generator 180 and stored in a database.

In another embodiment, a compressor may be used along with a pump or instead of a pump. A compressor can supply air at high pressure which may be necessary if the power generation apparatus is submerged in deep water, where the water pressure is significantly higher than the atmospheric pressure. For example at 100 m underwater, the water pressure is approximately 10 times the atmospheric pressure.

While assembling the power generation apparatus 180 care must be taken that all the connections are leak proof so that gas does not escape from the components into the water or water does not enter into the components. In case a leak is detected, the power generation apparatus 180 must be stopped and the leak should be fixed.

Figure 2:
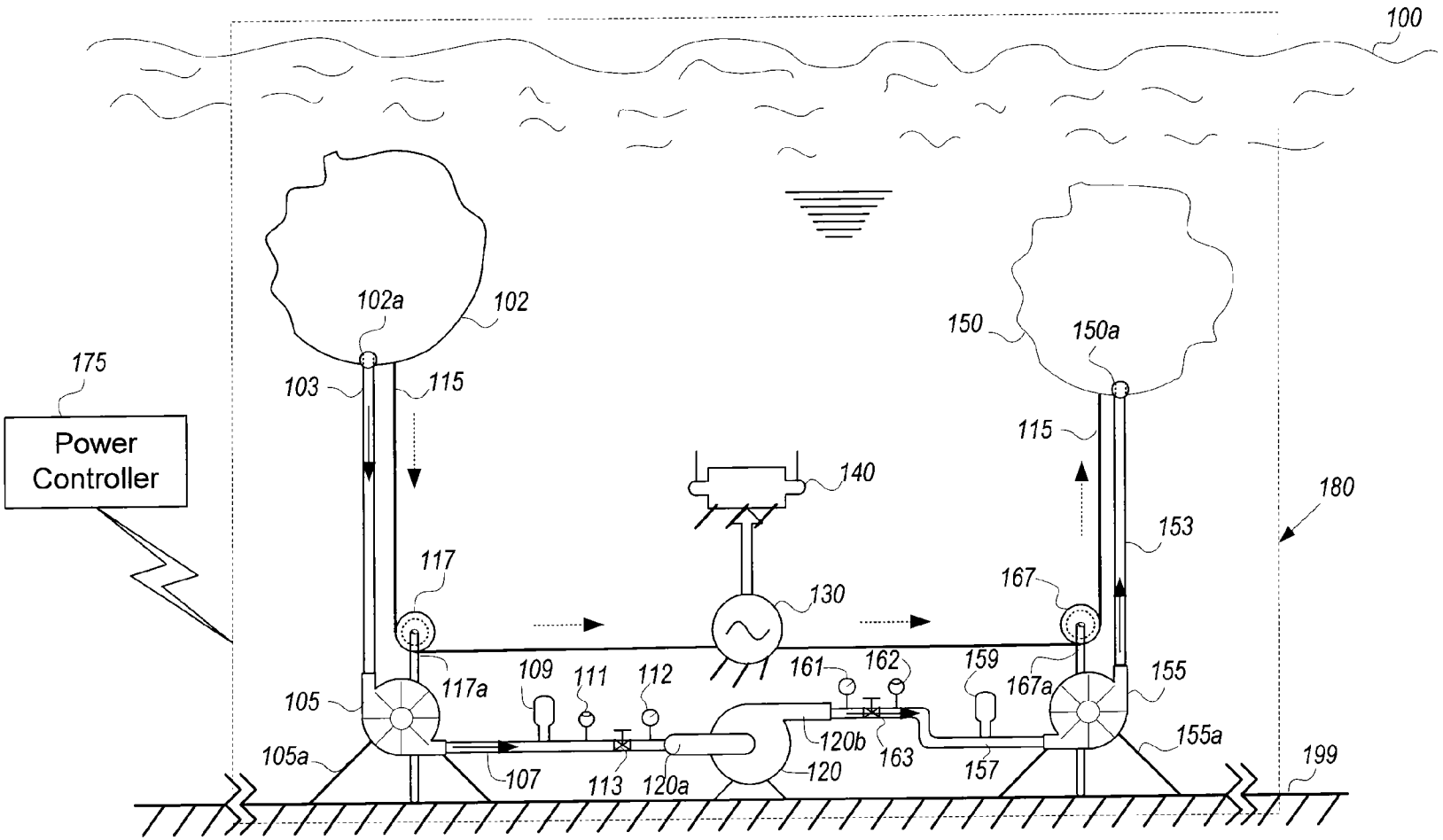
FIG. 2 illustrates the working process of the buoyancy power generation system shown in FIG. 1 according to an exemplary embodiment of the present disclosure.

FIG. 2 illustrates the working process of the buoyancy power generation system shown in FIG. 1. The operation of the power generator 180 begins when the power controller 175 starts the pump 120 and the first and the second valves 113 and 163 are open. The pump 120 sucks the gas from the first balloon 102 through the first port 120*a* and pumps out the gas at a relatively higher pressure than the first to the second balloon 150 through the second port 120*b*.

As the second balloon 150 inflates with gas it starts to rise due to the buoyancy effect, while the first balloon 102 descents as it deflates. Also, as the second balloon 150 is rising, the flexible hose 153 is unreeled from the hose reel 155 and the cord 115 connected to the second balloon 150 generates a force on the generator 130 while pulling the first balloon 102 downwards. For example, if the cord 115 is connected to a shaft (not shown) of the generator 130, then the shaft (not shown) experiences a torsional force and starts rotating. On the other hand the flexible hose 103 connected to the first balloon 102 is reeled into the hose reel 105. For example, the hose reel 105 may include a cylindrical shaft connected to a spring actuated which causes the cylinder to rotate thus reeling the flexible hose 103.

In another embodiment, the deflation of the first balloon 102 and the inflation of the second balloon 150 may be performed sequentially in two steps. For example, in first step the pump 120 can deflate the first balloon 102 and the air can be stored in an separate accumulator (not shown). In this case only the first valve 113 is opened while the second valve 163 is closed, which restricts the gas flow to the second balloon 150. In the second step, the gas from the compressor (not shown) can be released to the second balloon 150 by opening the second valve 163.

Figure 3:
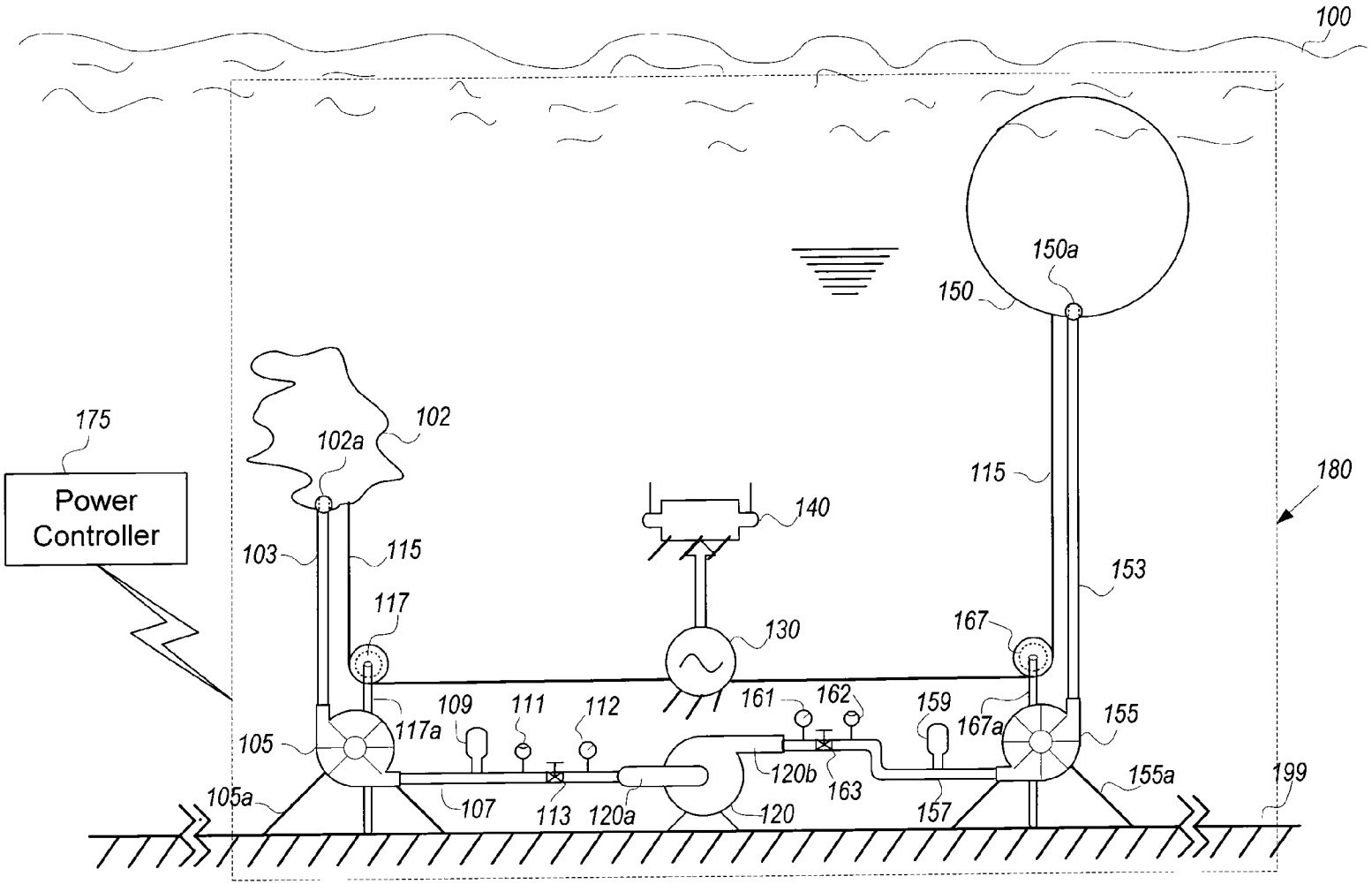
FIG. 3 illustrates a configuration after power is generated using the buoyancy power generation system shown in FIG. 1 according to an exemplary embodiment of the present disclosure.

FIG. 3 illustrates a configuration after power is generated using the buoyancy power generation system shown in FIG. 1. Referring to FIG. 3, the first balloon 102 (now in deflated state) is completely deflated and the entire gas is transferred to the second balloon 150 (now in inflated state). The second balloon 150 occupies a significantly higher position while the first balloon 102 occupies a significantly low position relative to the second balloon 150. The process from significant inflation of the second balloon 150 and significant deflation of the first balloon 102 is termed as one cycle, according to one embodiment of the present disclosure. Also amount of power generated in each cycle is significantly the same. The process is repetitive and continuous till a stop command is issued either via the power controller 180 or manually by turning off the valves and pumps.

At the end of each cycle, the pump 120 is in the stopped state. The second pressure sensor 161 shows a higher pressure relative to pressure shown by the first pressure sensor 111. Once the pressure difference between the first pressure sensor 111 and the second pressure sensor 161 reaches a maximum value the power controller 175 starts the pump 120 in the reverse direction. In another embodiment, the power controller 175 may start the pump 120 in the reverse direction when the second balloon 150 occupies the highest position.

Sample power generation calculations for buoyancy based power generation apparatus according to one embodiment of the present disclosure is discussed below.

The buoyancy force is an upward force exerted by a fluid on an immersed object. The buoyant force can be calculated using equation (1) below:

$$F_b=\rho*g*V \tag{1}$$

Where, $F_b$ is the buoyant force, ρ is the specific density an object (ρ is 1.225 for air), g is the gravitation acceleration (9.81 m/s) and V is the volume of the immersed body.

In mechanical systems, a force acting on a moving objects generates power (P) which can be approximated using equation (2) below:

$$P=F_b*\upsilon \tag{2}$$

Where, P is the power generated, $F_b$ is the buoyant force, ν is terminal velocity of the immersed object according to one embodiment of the present disclosure.

According to the embodiment of present disclosure, the velocity (ν) of the rising gas filled balloon can be approximated using the terminal velocity of a rising air bubble underwater. In one embodiment, the velocity of the rising gas filled balloon can be approximated using equation (3) for practical purposes.

$$\upsilon=2/3*(g*R)^{1/2} \tag{3}$$

Further, velocity of the rising gas filled balloon can be expressed in terms of volume of a bubble, which is has a significantly spherical shape as follows.

$$\upsilon=\frac{2}{3}*\left(g*\left(V*\frac{3}{4*pi}\right)^{\frac{1}{3}}\right)^{\frac{1}{2}} \tag{4}$$

Based on the above equation, the velocity of the rising gas balloon will depend on the radius of the balloon. In general, larger the radius of the gas filled balloon greater will its terminal velocity.

Furthermore, the velocity of the rising gas balloon can be affected by the depth underwater as well. A gas filled balloon at a relatively greater depth underwater rises faster compared to a filled balloon placed relatively close to the water surface. This phenomenon is observed due to the higher pressure exerted by the water as the depth increases. In another embodiment, the terminal velocity of the rising gas filled balloon can be determined experimentally. For instance a gas filled balloon may be immersed at different depths underwater and the terminal velocity achieved within a predetermined distance can be recorded and stored in a database. The predetermined distance can be the length of the cord 103. Further, the stored data of terminal velocity can be accessed through the power controller 175.

For illustration purposes, the amount of power generated and the number of households that can be powered using the power generation system according to the embodiment of the present disclosure is shown in tables 1 and 2. The values in table 1 and 2 are based on the equation 1-4 discussed earlier.

TABLE 1

Sample power generation calculation for one cycle

| rho | g | Volume ($m^3$) | $F_b$ (N) | Velocity (m/s) | Power (HP) | Power (W) |
|---|---|---|---|---|---|---|
| 1.225 | 9.81 | 0.005 | 0.06 | 0.68 | 0.041 | 30.65 |
| 1.225 | 9.81 | 0.5 | 6.01 | 1.47 | 8.80 | 6603.33 |
| 1.225 | 9.81 | 1 | 12.02 | 1.65 | 19.77 | 14823.98 |
| 1.225 | 9.81 | 2 | 24.03 | 1.85 | 44.37 | 33278.71 |

The gas filled balloon rising underwater having a volume of a soccer ball, which is approximately 0.005 $m^3$, generates a power of 30.65 W. A balloon having 100 times more volume than a soccer ball generates a power of 6603.33 W, which is approximately more than 200 times the power generated by a soccer sized gas filled balloon. Further the amount of power generated is calculated for only one cycle, which is deflation of the first balloon 102 and inflation of the second balloon 150.

Suppose each power cycle takes approximately 12 minutes, then in one hour approximately 5 cycles can be completed. Note that the amount of time required for each cycle may depend on several factors such as the pumping capacity of the pump, the gas flow rate and the velocity of the rising balloon. Further, based on the power generated in one cycle shown in table 1 and assuming that an average American household consumes 24000 W power per day, then the total number of households that can be powered each day is calculated in table 2. For example a gas filled balloon of approximately 100 times the size of the soccer can supply power of approximately 792399.98 W, which can power approximately 33 average American households. Further considering the efficiency of power generation is only 50% then approximately 16 average American households can be powered using the power generation apparatus according to one embodiment of present disclosure.

TABLE 2

Sample calculation of number of households served per day (assumed average household power consumption per day is 24000 W)

| Power (W) | #Cycles/hr | Power (W)/hr | Power (W)/day | #households | #households (50% power efficiency) |
|---|---|---|---|---|---|
| 30.65 | 5 | 153.25 | 3677.99 | 0.15 | 0.077 |
| 6603.33 | 5 | 33016.67 | 792399.98 | 33.02 | 16.51 |

TABLE 2-continued

Sample calculation of number of households served per day (assumed average household power consumption per day is 24000 W)

| Power (W) | #Cycles/hr | Power (W)/hr | Power (W)/day | #households | #households (50% power efficiency) |
|---|---|---|---|---|---|
| 14823.98 | 5 | 74119.91 | 1778877.82 | 74.12 | 37.06 |
| 33278.71 | 5 | 166393.57 | 3993445.68 | 166.39 | 83.2 |

In another embodiment, the power generation apparatus may include a plurality of balloons which may be filled using a pump having higher pumping capacity thus a greater power output can be generated compared to the power output from a single gas filled balloon.

Figure 4:
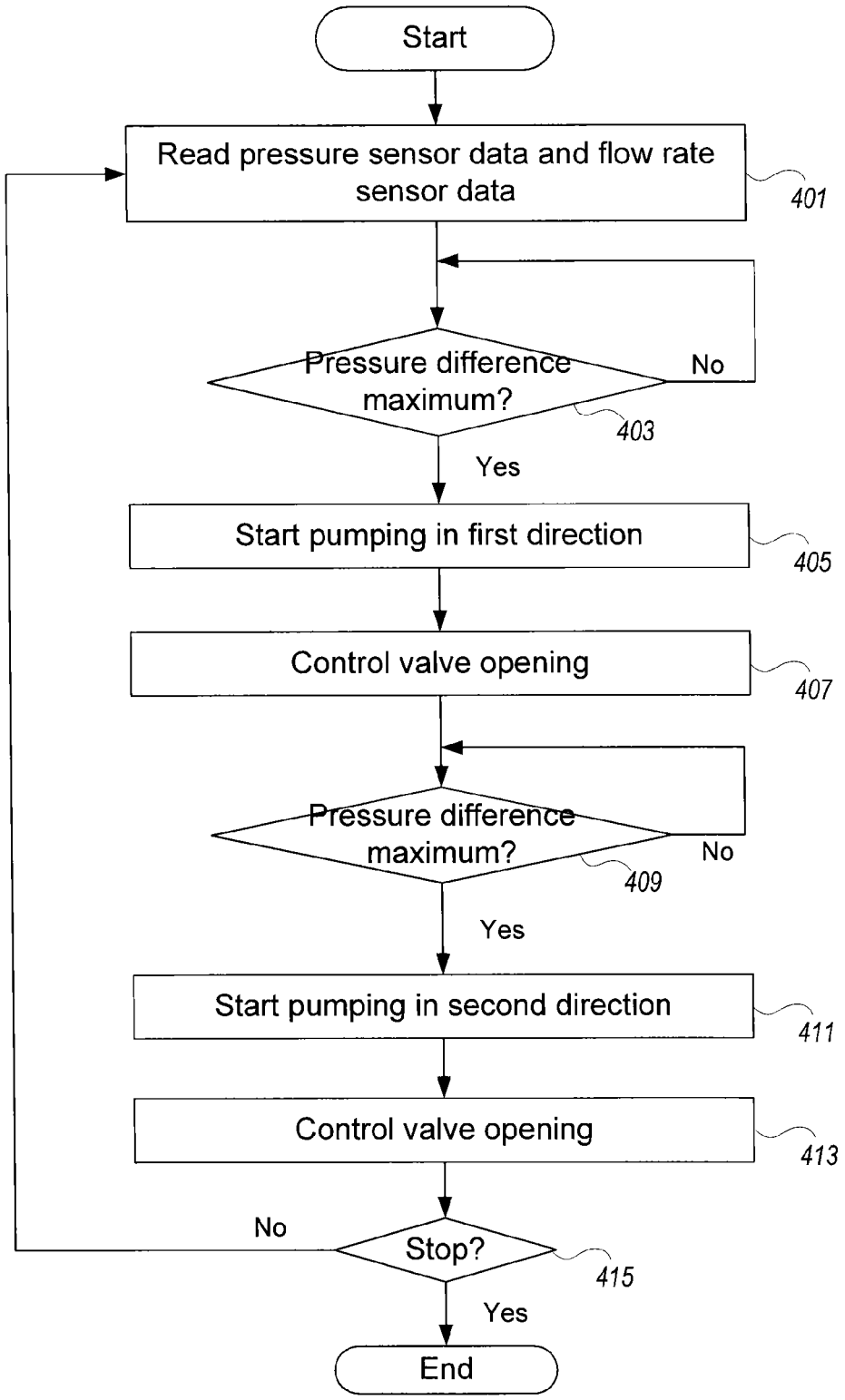
FIG. 4 illustrates a process for controlling the flow of gas between two balloons according to an exemplary embodiment of the present disclosure.

FIG. 4 illustrates a process for controlling the flow of gas between two balloons—one filled and one empty according to one embodiment of the present disclosure. The process is implemented in the power controller 175. The process starts when the power controller 175 is switched on. In step 401, data from the first pressure sensor 111, the second pressure sensor 161, the first flow rate sensor 112 and the second flow rate sensor 162 data respectively is read into the power controller 175. In step 403 a determination is made if the difference in the first and the second pressure has reached a predetermined maximum value. If the pressure difference reaches a maximum value, then the power controller 175 sends command to the pump to start pumping in the first direction. The first direction implies the direction from the first port 120*a* to the second port 120*b* of the pump 120, where the first port 120*a* of the pump 120 is connected to the first balloon 102 while the second port 120*b* of the pump 120 is connected to the second balloon 150. For instance, refer to directions marked in FIG. 2. If the pressure difference has not reached a predetermined maximum value, then the condition check in step 403 is continued to be performed.

In step 407, the flow rate to and from the pump 120 is controlled by controlling the amount of opening of the first and the second valves 113 and 163 respectively. Controlling the flow rate allows for controlling the amount of time required to fill the second balloon 150. If a high flow rate is maintained, the second balloon 150 can be filled in relatively less time compared to if a low flow rate is used. As such by increasing the flow rate the number of cycles performed in an hour can be increased which in turn will control the amount of power generated.

In step 409, the difference in pressure is checked again. If the pressure difference has not reached maximum, then the pumping continues in the first direction. When the pressure difference reaches maximum, it implies that the first balloon 102 is now in empty state while the second balloon 150 in now in filled state. In step 409, pumping is performed in the second direction. The second direction is reverse of the first direction. In step 413, the opening of the valves is controlled similar to that in step 407.

In step 415, if a stop command is not issued, then the above process continues to step 401 indicating a power generation is a continuous process. If a stop command is issued then the power generation apparatus 180 stops. The stop command may be issued manually by an operator or automatically. The stop command may be based on a leakage detection process such as based on difference in pressure or a reduced amount of power generation compared to the past operation.

Figure 5:
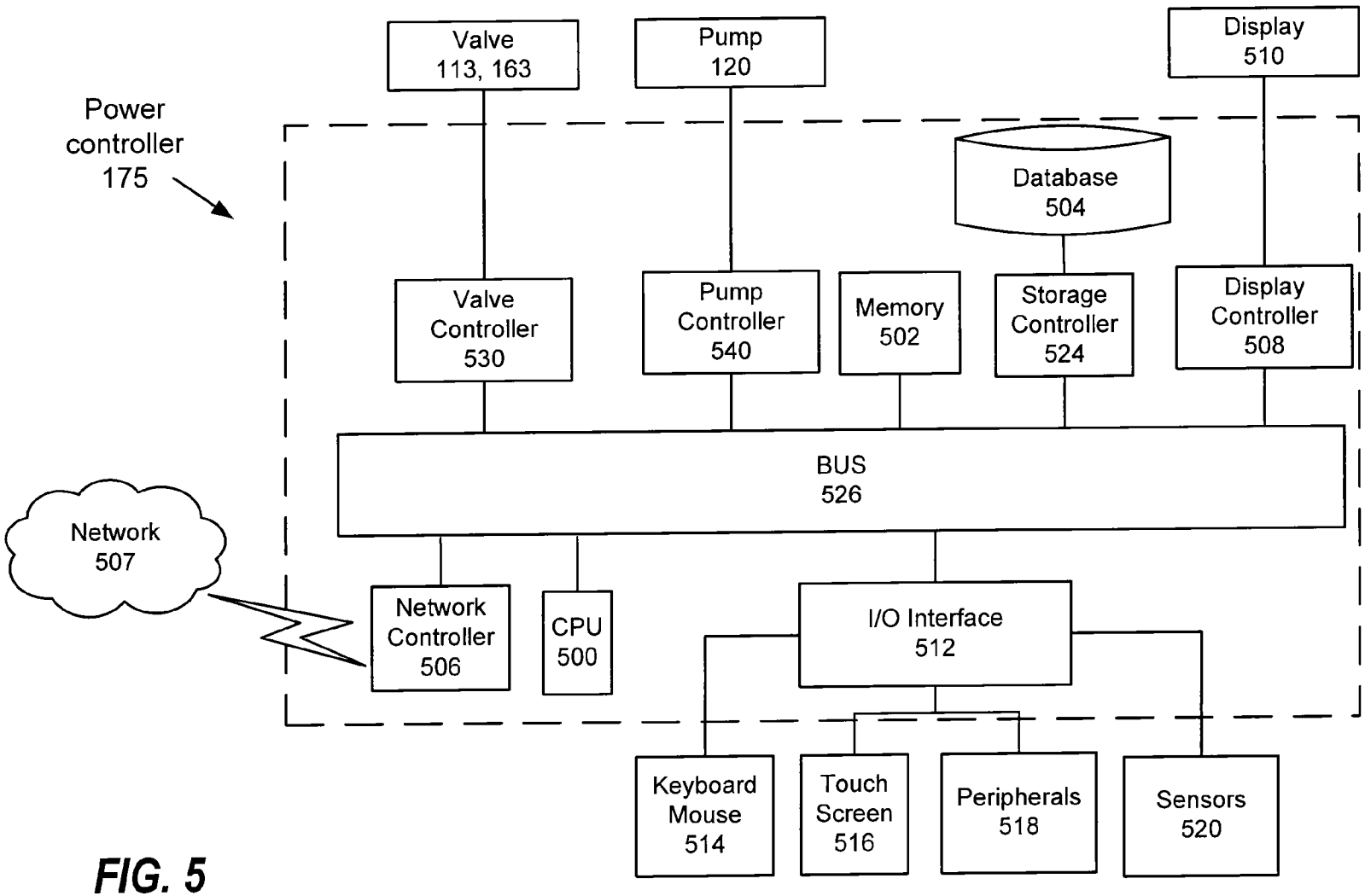
FIG. 5 is a block diagram of a computer hardware implementing a power controller according to an exemplary embodiment of the present disclosure.

FIG. 5 is a block diagram of a computer hardware implementing the power controller 175 according to exemplary embodiments of the present disclosure. The power controller 175 includes a CPU 500 which performs the processes described in FIG. 4. The process data and instructions may be stored in memory 502. These processes and instructions may also be stored on a storage medium disk 504 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computer aided design station communicates, such as a server or computer.

Further, the claimed advancements may be provided as a utility application, background daemon, or component of an operating system, or combination thereof, executing in conjunction with CPU 500 and an operating system such as MICROSOFT WINDOWS 7, UNIX, SOLARIS, LINUX, APPLE MAC-OS and other systems known to those skilled in the art.

CPU 500 may be a XENON or Core processor from INTEL of America or an Opteron processor from AMD of America, or may be other processor types that would be recognized by one of ordinary skill in the art. Alternatively, the CPU 500 may be implemented on an FPGA, ASIC, PLD or using discrete logic circuits, as one of ordinary skill in the art would recognize. Further, CPU 500 may be implemented as multiple processors cooperatively working in parallel to perform the instructions of the inventive processes described above.

The power controller 175 also includes a network controller 506, such as an INTEL Ethernet PRO network interface card from INTEL Corporation of America, for interfacing with a wireless network 507. As can be appreciated, the wireless network 507 can be a public network, such as the Internet, or a private network such as an LAN or WAN network, or any combination thereof and can also include PSTN or ISDN sub-networks. The wireless network 507 can also be wired, such as an Ethernet network, or can be wireless such as a cellular network including EDGE, 3G and 4G wireless cellular systems. The wireless network can also be WIFI, BLUETOOTH, or any other wireless form of communication that is known.

The power controller 175 further includes a display controller 508, such as a NVIDIA GeForce GTX or Quadro graphics adaptor from NVIDIA Corporation of America for interfacing with display 510, such as a Hewlett Packard HPL2445w LCD monitor. The display can be used to display information related to the amount of power generated, the first and second pressure sensor data, and the first and the second flow rate data. In case of a touch screen activated display pump control inputs like start and stop can be displayed as well. A general purpose I/O interface 512 interfaces with a keyboard and/or mouse 514 as well as a touch screen panel 516 on or separate from display 510. General purpose I/O interface also connects to a variety of peripherals 518 including printers and scanners, such as an OfficeJet or DeskJet from Hewlett Packard. Also sensors 520 may be connected to the I/O interface. For instance the first and second pressure sensors 111 and 161 respectively and/or the first and second flow rate sensors 112 and 162 respectively. The connections may be wireless with underwater communication capability or with waterproof wires.

The valve controller 530 is provided to control the opening of the first and the second valves 113 and 163 respectively. The valve controller 530 may be FPGA, an embedded system or an integrated chip that implements a valve control routine. The valve control routine can is based on the sensor data Further the power controller 175 includes a pump controller 540 which controls the pumping direction of the pump 120. The pump controller 540 may also control the pumping speed of the pump 120. The pump controller 520 may be FPGA, an embedded system or an integrated chip that implements a valve control routine.

The general purpose storage controller 524 connects the database 504 with communication bus 526, which may be an ISA, EISA, VESA, PCI, or similar, for interconnecting all of the components of the tracery controller 109. A description of the general features and functionality of the display 510, keyboard and/or mouse 514, as well as the display controller 508, storage controller 524, network controller 506, and general purpose I/O interface 512 is omitted herein for brevity as these features are known.

Also, it should be understood that this technology when embodied is not limited to the above-described embodiments and that various modifications, variations and alternatives may be made of this technology so far as they are within the spirit and scope thereof. For example, this technology may be structured for cloud computing whereby a single function is shared and processed in collaboration among a plurality of apparatuses via a network.

What is claimed is:

1. A power generation apparatus for underwater power generation comprising:

at least two balloons completely submerged under a water surface of a water body, wherein a first balloon is filled with a gas and a second balloon is initially empty;

a plurality of flexible hoses connected to the at least two balloons, wherein a first flexible hose of the plurality of flexible hoses is connected to the first balloon in an airtight manner and a second flexible hose of the plurality of flexible hoses is connected to the second balloon in an airtight manner;

a plurality of hose reels attached to supports that are fixed to a floor underwater, each hose reel winds one of the plurality of the flexible hoses;

a plurality of pulleys hinged to a support that is fixed to the floor underwater;

a cord that freely passes over the plurality of pulleys and connects to the first balloon and the second balloon;

a pump connected to a first pipe and a second pipe, the first pipe connected to the first flexible hose through a first hose reel of the plurality of hose reels and the second pipe connected to the second flexible hose through a second hose reel of the plurality of hose reels each in an airtight manner;

a first valve located in the first pipe, and a second valve located in the second pipe;

at least two pressure sensors and at least two flow rate sensors, wherein a first pressure sensor and a first flow rate sensor are connected to the first pipe and a second pressure sensor and a second flow rate sensor are connected to the second pipe;

a power controller that reads and stores data from the at least two pressure sensors and the at least two flow rate sensors, controls an opening of the first valve and the second valve, and a pumping direction of the pump based on data from the at least two pressure sensors and the at least two flow rate sensors; and a generator operated by the cord.

2. The power generation apparatus for underwater power generation according to claim 1, wherein the gas is air, hydrogen or helium.

3. The power generation apparatus for underwater power generation according to claim 1, wherein the plurality of flexible hoses are connected to the at least two balloons by a respective ball and socket joint.

4. The power generation apparatus for underwater power generation according to claim 1, wherein the pump is bidirectional.

5. The power generation apparatus for underwater power generation according to claim 1, wherein the pump receives power from an external power source outside the water body.

6. The power generation apparatus for underwater power generation according to claim 1, wherein the pump receives power from an energy storage device connect to the generator.

7. The power generation apparatus for underwater power generation according to claim 1, wherein the generator generates power when the cord moves upwards towards the water surface.

8. The power generation apparatus for underwater power generation according to claim 7, wherein the cord moves upwards towards the water surface when the second balloon receives the gas from the pump through the second flexible hose.

9. A method for controlling power generated from the power generation apparatus submerged underwater comprising: a first balloon filled with a gas and a second balloon initially empty; a first gas pipe connected with a first pressure sensor, a first valve, a first flow rate sensor and connected to the first balloon; a second gas pipe connected with a second pressure sensor, a second valve, a second flow rate sensor and connected to the second balloon; a cord connecting the first balloon at one end and the second balloon at other end via a generator and a pump connecting the first gas pipe to the second gas pipe, the method comprising:

reading the first and the second pressure sensor data, and the first and the second flow rate sensor data;

calculating a difference in pressure based on the first and the second pressure sensor data;

starting the pump based on the calculated pressure difference;

controlling the first valve and the second valve based on the first and the second flow rate sensor data allowing the gas to flow from the first balloon to the second balloon causing the second balloon to inflate and rise while the first balloon deflates and descents and the cord to move in a direction of a flow of the gas while pulling the first balloon downwards, thereby producing power at the generator; and stopping the pump.

10. The method for controlling power generated from the power generation apparatus submerged underwater according to claim 9, wherein the pump extracts the gas from the first balloon and deliver the gas to the second balloon.

11. A non-transitory computer-readable medium storing a program which when executed by a computer, causes the computer to perform a method for controlling power generated from the power generation apparatus submerged underwater comprising: a first balloon filled with a gas and a second balloon initially empty; a first gas pipe connected with a first pressure sensor, a first valve, a first flow rate sensor and connected to the first balloon; a second gas pipe connected with a second pressure sensor, a second valve, a second flow rate sensor and connected to the second balloon; a cord connecting the first balloon at one end and the second balloon at other end via a generator and a pump connecting the first gas pipe to the second gas pipe, the method comprising:

reading the first and the second pressure sensor data, and the first and the second flow rate sensor data;

calculating a difference in pressure based on the first and the second pressure sensor data;

starting the pump based on the difference in pressure to extract the gas from the first balloon and deliver the gas to the second balloon;

controlling the first valve and the second valve based on the first and the second flow rate sensor data allowing the gas to flow from the first balloon to the second balloon causing the second balloon to inflate and rise while the first balloon deflates and descents and the cord to move in a direction of a flow of the gas while pulling the first balloon downwards, thereby producing power at the generator; and stopping the pump.

* * * * *